United States Patent [19]

Schultz et al.

[11] Patent Number: 5,061,233

[45] Date of Patent: Oct. 29, 1991

[54] METHOD AND APPARATUS FOR BUSINESS FORMS COMPACTING

[75] Inventors: Elmer G. Schultz, Sandborn, N.Y.; Robert E. Godfrey, Rochester, N.H.; Thomas D. Chapman, Denton, Tex.

[73] Assignee: Moore Business Forms, Inc., Grand Island, N.Y.

[21] Appl. No.: 559,962

[22] Filed: Jul. 30, 1990

[51] Int. Cl.[5] ..... B65H 29/00

[52] U.S. Cl. ..... 493/410; 493/416; 414/798.2

[58] Field of Search ..... 493/357, 358, 359, 360, 493/405, 406, 407, 408, 410, 411, 412, 413, 416, 417, 436; 414/798.2, 798.8; 271/149, 150, 151

[56] References Cited

U.S. PATENT DOCUMENTS

| | | | |
|---|---|---|---|
| 2,699,942 | 1/1955 | Rineer | 271/68 |
| 3,236,162 | 2/1966 | Reist | 414/798.2 |
| 3,406,959 | 10/1968 | Ross | 493/359 |
| 3,700,232 | 10/1972 | Weigert et al. | 271/75 |
| 3,883,131 | 5/1975 | Anderson, Jr. et al. | 493/416 |
| 3,945,635 | 3/1976 | Marin | 271/202 |
| 3,986,614 | 10/1976 | Fernandez-Rana et al. | 414/798.2 |
| 4,102,531 | 7/1978 | Jimirez | 493/412 |
| 4,172,531 | 10/1979 | Muller | 414/108 |
| 4,245,832 | 1/1981 | Klenk et al. | 271/185 |
| 4,531,343 | 7/1985 | Wood | 53/399 |
| 4,718,656 | 1/1988 | Reist | 271/3.1 |
| 4,750,724 | 6/1988 | Herd et al. | 493/407 |

OTHER PUBLICATIONS

*IBM Tech. Disclosure Bulletin*, "Forms Creasing, Folding and Refolding Machine", Lavin & Schall, vol. 7, No. 4, Sep. 1964.

*Primary Examiner*—William E. Terrell
*Assistant Examiner*—John A. Marlott
*Attorney, Agent, or Firm*—Nixon & Vanderhye

[57] ABSTRACT

Fan folded business forms are compacted so as to provide the maximum run time, and minimum operator effort. The system includes a folder, transfer table with compacting conveyor, and wheeled cart with a backstop on it. The backstop is continuously pushed along the cart by the compacting forms until it reaches a position at the end of the cart, at which time a cart full sensor operates an alarm and/or shuts off the folder. The compacted forms on the cart may be easily moved to any desired location. Forms may be fed either printed side up or printed side down into another piece of equipment. The main surface of the cart on which the forms travel with their fold lines engaging the main surface, may be manually tilted about a horizontal axis after the cart is full, so that the end of the cart from which forms are to be withdrawn is elevated. This provides efficient withdrawal of forms while minimizing curling of the forms.

29 Claims, 4 Drawing Sheets

FIG. 4
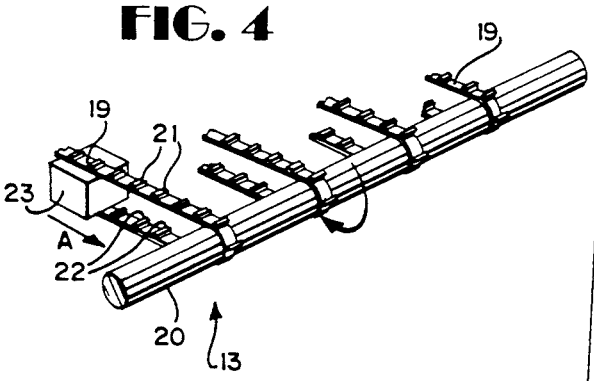
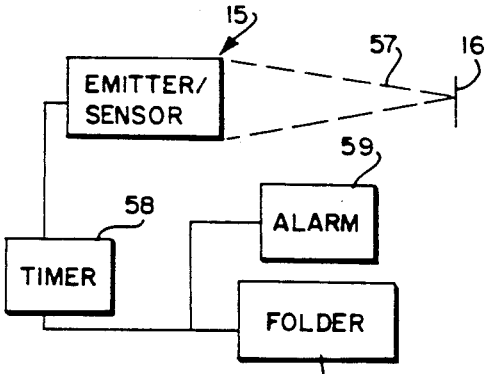
FIG. 6
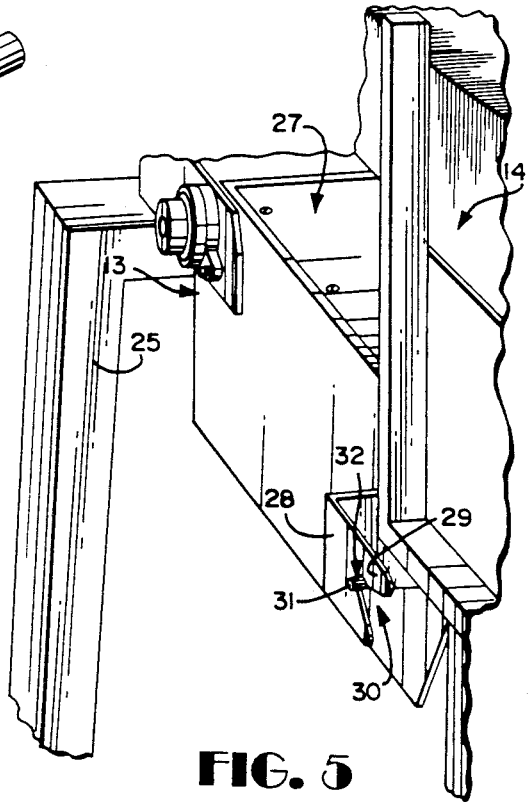
FIG. 5
FIG. 7
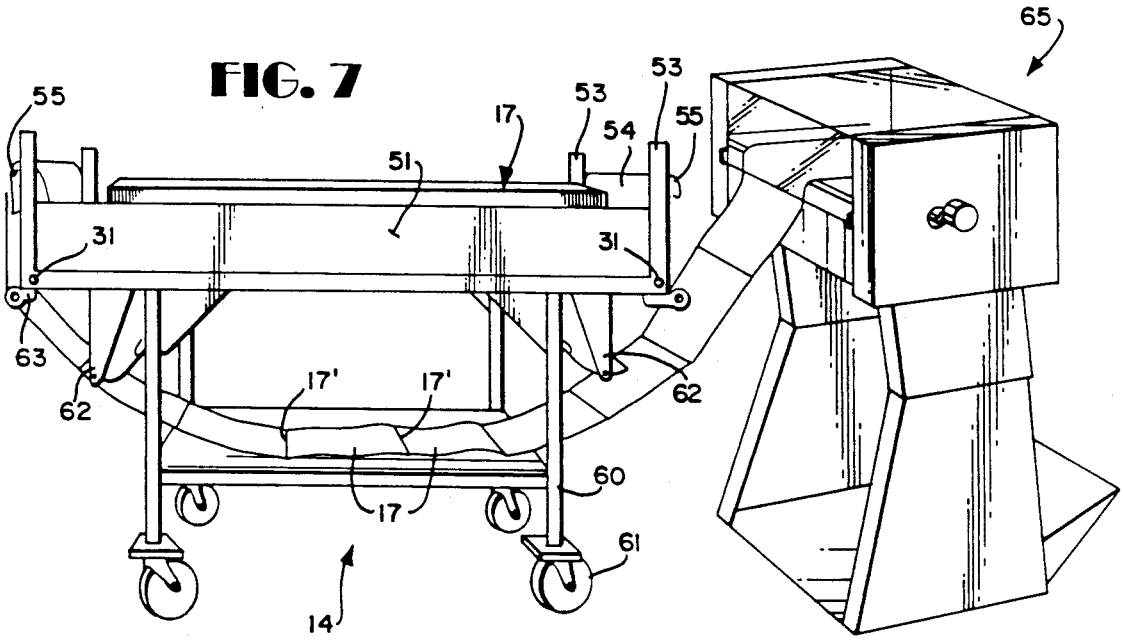

METHOD AND APPARATUS FOR BUSINESS FORMS COMPACTING

BACKGROUND AND SUMMARY OF THE INVENTION

The invention relates to a cart, system, and method of compacting fan folded business forms by causing them to stand on end, in line, so that capacity can be maximized and the operator need not constantly intervene in the process because a forms conveyor is full.

According to one aspect of the invention there is provided a method of compacting continuous business forms utilizing a movable cart with a forms backstop mounted thereon. The method comprises the steps of: (a) Folding the forms along fold lines. (b) Transporting the folded forms in a first direction at a first speed. (c) Physically engaging the forms being transported in the first direction at the first speed, and significantly slowing down their transport in the first direction to a second speed, lower than the first speed, so that the forms stand substantially upright on a folded edge. (d) Pushing the substantially upright forms in the first direction at the second speed into operative engagement with the forms backstop located on the movable cart so that the forms are compacted. And, (e) once the movable cart is full of compacted forms, terminating feed of forms onto it, and replacing it with an empty cart. A mail infeed unit, or like piece of forms utilization equipment, may be employed to act on the folded forms, in which case the method comprises the further steps of: (f) Moving the full cart from step (e) into operative association with the forms utilization unit. And then, (g) feeding continuous forms from the cart to the form utilization unit. Further, after step (e) the main surface of the cart is tilted so that a first end thereof is substantially higher than the opposite end, and steps (f) and (g) are then practiced so that the forms are fed from the first, higher, end of the cart to the forms utilization unit.

The cart according to the invention comprises: A forms backstop having a bottom surface, and a top. A cart main surface for supporting compacted forms thereon, having a periphery and having means for providing appropriate frictional engagement with the forms backstop bottom surface and forms, while the backstop top extends upwardly above the main surface, to facilitate compacting of forms. Wall means upstanding from the main surface around at least part of the periphery thereof, and defining at least one openable end for receipt of forms. And, a plurality of legs supporting the main surface, with roller means at the bottoms of the legs.

The frictional engagement providing means of the cart may comprise a plurality of lugged belts movable along the main surface with low friction portions of the main surface disposed under the belts, or the surface may be a corrugated aluminum surface. The forms backstop is generally triangular in shape with a forwardly extending lip from the bottom surface thereof and a handle adjacent the top thereof. The bottom surface may have at least a portion thereof formed of a lubricant impregnated material to facilitate sliding action—without binding—along the main surface. The main surface is mounted for tilting action about a horizontally extending shaft disposed below the main surface, and a spring loaded detent is provided for holding the main surface into a position to which it has been tilted, e.g. about 30° from horizontal.

A system according to the invention, which employs the cart as forth above, comprises: A folder for folding the continuous business forms along fold lines, and for conveying the folded forms in a first direction at a first speed. Conveying means for conveying forms received thereby in the first direction at a second speed, slower than the first speed. Means for mounting the conveying means adjacent the folder so that folded forms discharged by the folder are received by the conveying means. A movable cart having a main surface, and wall means upstanding from the main surface and defining a first, openable, end, the main surface for receipt of forms discharged by the conveying means. A forms backstop movable along the main surface in response to forms stacking thereagainst. And, means for mounting the main surface adjacent the conveying means so that forms discharged by the conveying means compact on the forms backstop.

Preferably means are also provided for sensing when the cart is full of forms and for operating a human perceptible device (e.g. an alarm, or terminating operation of the folder) in response to the full-cart sensing. The cart may have a second end defined by an end wall, opposite the first end, and the sensing means may comprise means mounted on the folder for emitting and sensing electromagnetic radiation, and reflective means mounted on the second end wall below the top of the forms backstop, but in position to receive a beam of radiation emitted by the emitting and sensing means and to reflect it back to the emitting and sensing means except when the beam of radiation is interrupted by the forms backstop (indicating that the cart is full of forms).

It is the primary object of the present invention to provide for effective compacting of folded continuous business forms so that they may be readily utilized in subsequent operations. This and other objects of the invention will become clear from an inspection of the detailed description of the invention, and from the appended claims.

BRIEF DESCRIPTION OF THE DRAWINGS

FIG. 4 is a schematic illustration of the lugged belt conveyor associated with the folder of the system of FIG. 1, which effects a stand-up of the forms;

FIG. 5 is a detail perspective view showing an exemplary interconnection between the conveyor and cart of the system of FIG. 1;

FIG. 6 is a control schematic, for "cart full" sensing, of the system of FIG. 1;

FIG. 7 is an isomeric view of a full forms cart of the system of FIG. 1 in association other machinery for utilizing the forms from the cart;

DETAILED DESCRIPTION OF THE DRAWINGS

Figure 1:
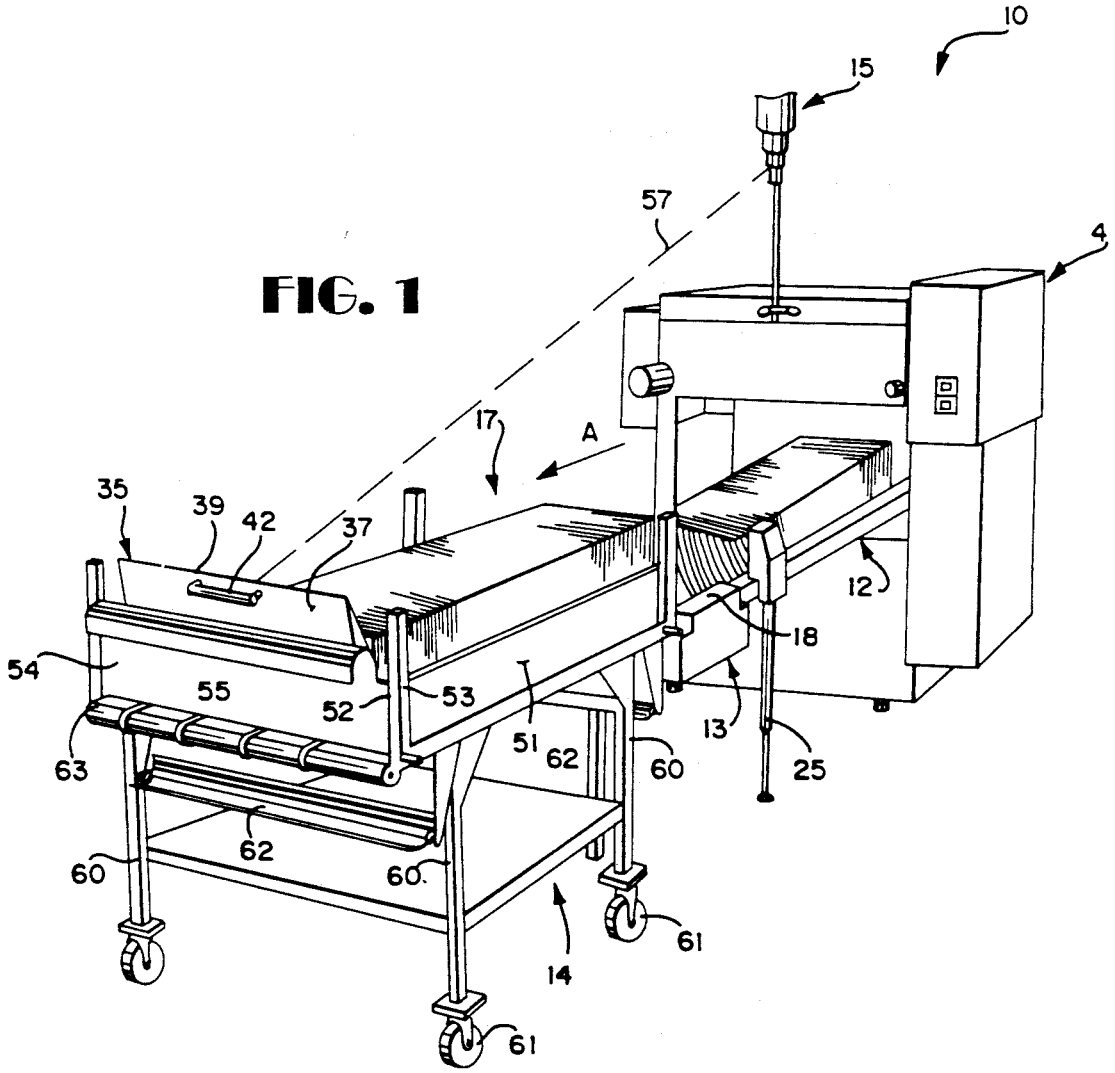
FIG. 1 is a perspective schematic view of a first embodiment of an exemplary system according to the invention.

An exemplary system for stacking continuous business forms in a compacted in-line configuration is illustrated generally by reference number 10 in FIG. 1. The major components of the system 10 include the folder 4, having a delivery table 12, a transfer table 13, and a movable cart 14. Cart "full" sensing is provided by the emitter/receiver 15 mounted on the folder 4, and retro-reflective (glass bead) tape 16 or the like associated with the cart 14.

Figure 2:
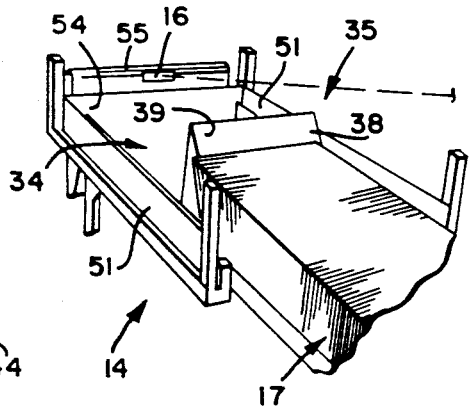
FIG. 2 is a perspective detail view of the coupling plate and main surface of the cart of the system of FIG. 1 as the cart is being filled with upstanding folded forms.

The folder 4 is a conventional folder, such as a fan folder sold by Moore Business Forms, Inc. of Glenview, Ill. under the designation "8700 Folder" or "8800 Folder". The folder 4 is typically, or although by no means exclusively, used with high speed laser printers which have jumbo roll unwind units. The continuous folder 4 fan folds business forms while they are maintained in continuous configuration, forming fold lines, and the folder delivery table 12 includes a conventional conveyor which conveys the fan folded forms from the folder 4 in a first direction A, at a first speed. Folded forms are seen generally at reference numeral 17 in FIGS. 1 and 2.

Immediately adjacent the conveyor and delivery table 12 of the folder 4 is a transfer table 13 which comprises means for conveying forms 17 received thereby in the first direction A at a speed substantially lower than the speed of conveyance by the conveyor of the delivery table 12. The conveying means 13 comprises a short table 18 which supports a plurality (e.g. five) of driven lugged or ribbed elastomeric belts 19 (see FIG. 4). The elastomeric belts 19, which travel around rollers spaced apart in the dimension A, one of which rollers is shown at 20 in FIG. 4, have upstanding ribs or lugs 21 on the outside or outward surface thereof, and like lugs or ribs 22 on the inside or inward surface thereof.

The outward lugs 21 of belts 19 engage the rear edges of the forms 17 along the fold lines 17' thereof, and since the belts 19 are driven at a much slower speed than the conveyor associated with the delivery table 12, the forms are caused to be elevated, to stand on edge so that they assume a generally vertical orientation. The lugs 22 engage any suitable conventional drive motor—shown only schematically at 23 in FIG. 4. The power for driving the motor 23 may be provided from the folder 11.

The transfer table 13 may be connected to the folders delivery table 12 in any conventional manner for connecting together two conveyor sections, but it is desirable—to ensure correct horizontal position of the transfer table 13—to utilize an adjustable support leg 25 (see FIG. 1).

Associated with the belt 19 (not shown in FIG. 4) for supporting the forms on the transfer table 13 is a stainless steel plate surface 27 (see FIG. 5), which leads up to the cart 14. The cart 14 and transfer table 13 are readily releasably attached together by any suitable releasable connection. In the embodiment illustrated in FIG. 5, this is provided by brackets 28 attached to both sides of the plate 27 and extending downwardly therefrom, each having a free end 29 with means defining a V-shaped notch 30 therein. Each V-shaped notch 30 is designed to cooperate with a pin 31 extending outwardly from each side of the cart 14 at the ends thereof. Since it is desired that the cart 14 be completely bi-directional, such pins 31 extend outwardly from each of the four corners of the cart 14. A half-round notch 32 is provided at the top of cut-out 30 for receipt of the pin 31 to hold the cart in place.

When the cart 14 is pushed into operative association with the transfer table 13, the pins 31 slide into the V slots 30, lifting the brackets 28 at the ends 29 until the pins 31 snap into the notches 32. To disengage the cart, a quick jerk on the cart 14 causes the pins 31 to cam the bracket ends 29 upwardly, to allow the pins 31 to be removed from the notches 32.

The cart 14—as seen in FIGS. 1 through 3 and 5—has a main surface (shown generally by reference numeral 34; see FIGS. 2 and 3 in particular) which receives the folded forms 17 thereon. A forms backstop 35 moves along the main surface 34 and facilitates the forms compacting operation. The backstop 35 functions to raise up the leading forms from the folder 11 and transfer table 13, hold the forms at the desired angle, and make sure that the compacting operation is optimum —that is there is a minimum waste of forms. If the backstop 35 is not utilized, compacting will not be nearly as efficient, and the cart 14—if it has a three box of forms capacity when operated optimally with the backstop 35—would have only a two and a half box forms capacity.

The backstop 35 may have a wide variety of configurations and be made of a wide variety of materials. One exemplary material is sheet metal. For example the backstop 35 may be made of anodized aluminum, or steel painted with a vinyl base paint. Other materials are also suitable.

Figure 3:
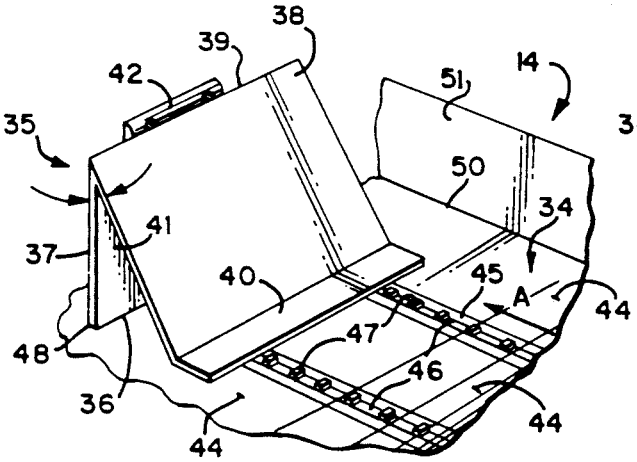
FIG. 3 is a detail perspective view showing an exemplary forms backstop according to the invention in association with lugged belts on the cart.

As perhaps seen most clearly in FIG. 3, the backstop 35 has a generally triangular configuration, with bottom edges 36, an upstanding rear portion 37, and a sloping front 38. The sloping front 38 and upstanding rear portion 37 meet at a top apex 39. The opposite ends of the surfaces 37, 38 form the bottom edges 36. Note that it is desirable—though not absolutely essential—for there to be a lip 40 defining the bottom edge which extends outwardly, opposite to the direction of form loading A, from the front surface 38. The lip 40 typically has a length of about one-half to one inch, so that it is disposed under the first few forms which engage the front surface 38.

The angle 41 between the surfaces 37, 38 is typically about 20° to 40°. This means that the forms are substantially vertical during compacting, but not necessarily completely vertical. A handle 42 preferably is provided adjacent the top 39 and extending outwardly from the back surface 37. One purpose of the handle 42 is to reverse the stack angle of the forms, typically after filling of the cart 14. This is typically accomplished by the operator grabbing the handle 42, and lifting on it while pivoting the backstop 35 about the front edge portion 40.

The purpose of the cart main surface 34 is to provide support for the forms 17 and the backstop 35, and it provides appropriate frictional engagement with the backstop 35 and the forms 17 so that compacting occurs. The desirable frictional properties are preferably provided—for the embodiment of FIGS. 1 through 7—by providing the surface 34 as aluminum plate at portions 44, with Teflon®—or like low friction material—strips 45 between the plates 44, and lugged belts of elastomeric material 46 riding over the low friction strips 45. The elastomeric belts 46 have lugs or ribs 47 extending upwardly from the surface 34, but are smooth on the bottom—that is the portion that engages the strips 45.

One of the functions of the ribs 47 is to be engaged by the back corner 48 of the backstop 35 so that as the forms are driven onto the cart 14 the backstop 35 will drive the belts 46 in direction A (the belts 46 are not otherwise driven). The belts 46 go around idler rollers (not shown) at opposite ends of the cart 14. The rear edge 48 engages a rib 47, yet the backstop 35 does not interfere with the rest of the ribs 47 since the bottom of the backstop 35 between the bottom surface/edge portions 36 is open, as seen in FIG. 3. The ribs 47 also serve to hold the forms 17 in place during cart unloading.

The surface 34 preferably is quadrate (rectangular) in configuration, having at the periphery—e.g. peripheral edge 50 (see FIG. 3) thereof—upstanding walls. In the preferred embodiment, the side upstanding walls 51 are permanent, however the ends of the cart 14 are not defined by permanent walls. Rather means are provided defining channels 52, in upright edge posts 53, at each corner of the cart 14, and a removable end wall—such as end wall 54 in FIGS. 1 and 2 —is provided where desired. During forms compacting as the cart is being filled, the end wall 54 preferably is in place at the cart end remote from folder 11, while at the opposite end no end wall is present so that the forms may be driven onto the cart 14. However after the cart 14 is loaded, then an end wall comparable to the end wall 54 is typically placed at the formerly open end.

The end wall 54 preferably has a curved tòp portion 55. This is to facilitate form withdrawal. Also, on the inside surface at the top of the wall 54, the retroreflective tape 16 is provided. The top 39 of the backstop 35 is higher than the tape 16, so that when the backstop 35 moves adjacent to the wall 54 (see FIG. 1) the beam of electromagnetic radiation (e.g. light) 57 from the emitter/receiver 15 is interrupted. This means that the light will not be reflected back to the emitter/receiver 15 by the retroreflective tape 16, which will be interpreted as a "cart full" condition.

FIG. 6 schematically illustrates the interconnection between components for the "cart full" sensing. When the light beam 57 is not reflected back to the emitter/-sensor 15, after the passage of a time delay—occasioned by timer 58—to prevent cart full sensing when there is only a temporary interruption of the beam 57 (as by the operator walking past or moving his/her hand over the cart 14), a human perceptible device is operated. This human perceptible device typically is an audio alarm 59. Subsequently, typically shortly after the alarm 59 is operated, the folder 11 is shut down. The folder 11 typically would be shut down within one to two minutes after the sensor beam 57 is broken.

Preferably, a plurality of legs 60 are provided for supporting the main surface 34 of the cart 14, and casters 61, or like cart movement facilitating structures (roller means), are provided at the bottoms of the legs 60. The volume between the legs 60 typically is open, however in order to facilitate versatility of unloading forms 17 from the cart 14. Curved forms guide plates 62 may be provided below both ends of the cart 14. For basically the same purpose, idler rollers 63 may also be provided at the ends of the cart 14 adjacent, but slightly lower than, the main surface 34.

FIG. 7 illustrates a typical unloading position of the cart 14. The cart 14—with end walls 54 at both ends thereof—has been detached from the transfer table 13 and moved into operative association with a forms utilization unit 65 (see FIG. 7), such as a mail system infeed unit. The continuous forms 17 may be fed into the unit 65 either printed face up or printed face down. If the printed face is to be up, the forms may be simply removed from the end of the cart 14 closest to the unit 65, passing over the curved top 55 of the end wall 54 closest to the unit 65. If the forms are to be fed printed face down—as illustrated in FIG. 7—then the forms are removed from the end of the cart 14 most remote from the unit 65, passing over the curved edge 55 of the remote end wall 54, around roller 63, under curved guide 62, between the cart legs 60, and ultimately to the unit 65.

Operation

An exemplary operation of the system illustrated in FIGS. 1 through 7 will now be described. The adjustable leg 25 of the transfer table 13 is adjusted so that the discharge from the folder 11 is at the correct height, and an open end of the cart 14 is pushed into engagement with the transfer table 13, the pins 31 of the cart 14 latching in the half-round holes 32 of the brackets 28 of the transfer table 13. The folder 11 is started so that forms 17 are folded along fold lines 17' (see FIG. 7) thereof, and are conveyed at a relatively high speed by the conveyor of the folder delivery table 12 in the first direction A at a first speed. The folded forms 17 pass into engagement with the lugged elastomeric belts of the transfer table 13, and the stainless steel plate 27. Since the belts 19 are being driven at a second speed significantly lower than the first speed, the forms 17 "stand up") on alternating fold lines 17', the bottom edges of the forms along the fold line 17' being engaged by the outer ribs 21 of the belts 19, and driven onto the cart 14 main surface 34.

The first form 17 is pushed into engagement with the sloping front surface 38 of the forms backstop 35, and the lip 40 extends under the first few forms. In the initial position, the backstop 35 is adjacent the end of the cart 14 closest to the folder 11, with the back edge 48 thereof engaging ribs 47 of belts 46, and the bottom surface edges 36 thereof engaging the surface 34. As the cart fills by forms 17 being driven in direction A, the forms backstop 35 is also driven in that direction, and drives the belts 46—which slide along low friction strips 45—in that direction. The vectored weight of the forms 17 on the surface 38 maintains the backstop 35 in proper contact with the ribs 47, and the entire cooperation between these components ensures that the backward movement of the backstop 35 is smooth and regular rather than jerky.

Ultimately, the backstop 35 is driven rearwardly to the point where the top 39 thereof interrupts the beam 57 from the emitter/receiver 15, causing—through the time delay 58—the alarm 59 to be actuated, and subsequently the operation of the folder 11 is stopped. At this point the operator detaches the last form that is on the cart 14 from the first form on the transfer table 13 (or, looking at it another way, last form on the transfer table 13 from the first form on the cart 14), an end wall 54 is slid into the channels 52 of the upstanding bars 53 at the formerly open end of the cart 14, with a jerk movement the cart pins 31 are detached from the brackets 28 of the transfer table 13, and the cart 14 is wheeled to another location in operative association with a forms utilization device 65. Assuming that the forms are to be fed printed face down into the unit 65, the forms 17 from the end of the cart 14 most remote from the unit 65 are passed over the rear end of the cart, into engagement with roller 63 and guide 62, between the legs 60, and into the unit 65.

Utilizing the system, and practicing the method, according to the invention, forms need be removed from the printer/rolls system (through folder 11) only once about every 45 minutes. There is no lifting of the stacks of forms onto and off of carts, and because three boxes of forms may be provided on one cart 14, each run into the mail system in feed unit 65 may be three times longer than conventional.

FIGS. 8 through 12 illustrate a second embodiment of a forms cart according to the present invention. In the FIGS. 8 through 12 embodiment, structures comparable to those in the FIGS. 1 through 7 embodiment are illustrated by the same reference numeral only preceded by a "1".

Figure 8:
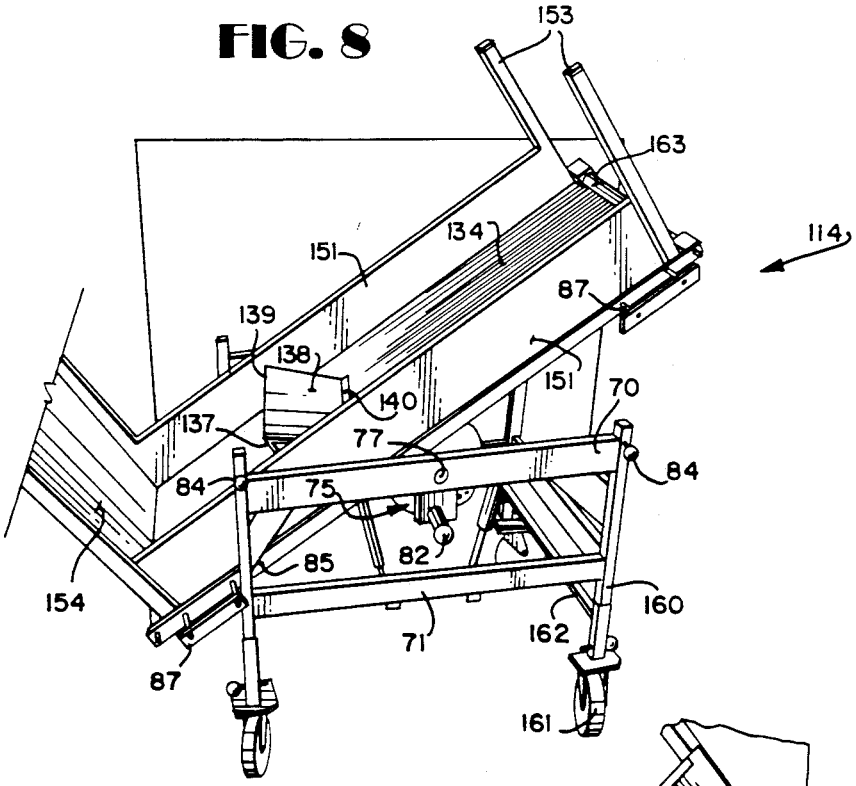
FIG. 8 is a top perspective view of a second embodiment of cart utilizable in the rest of the system of FIG. 1, showing the cart main surface tilted approximately 30° with respect to the horizontal.
Figure 9:
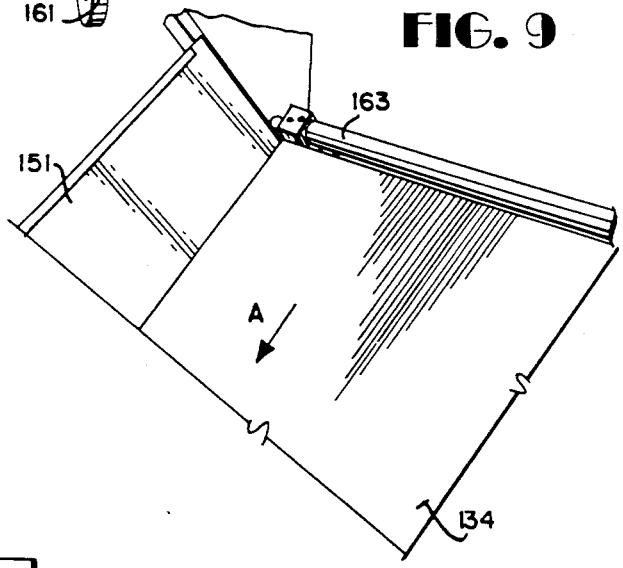
FIG. 9 is a top perspective view of the corrugated aluminum main surface of the cart embodiment of FIG. 8.

The forms cart 114 primarily differs from the cart 14 in the construction of the main surface 134 and backstop 135, and in the fact that the main surface 134 is mounted for tiltable movement about a horizontal axis. FIG. 8 shows the surface 134 tilted about 30° to the horizontal with respect to the legs 160 and supporting frame elements 70, 71 of the cart 114. The main surface 134—as seen somewhat in FIG. 8, and more clearly in FIG. 9—comprises a corrugated or ribbed surface, preferably made out of corrugated or ribbed aluminum, with the corrugations and ribs extending in the direction A. This is vastly superior to a flat plate which does not have the desired frictional characteristics to effect uniform, nonjerky, movement of the forms backstop 135 therealong.

Figure 10:
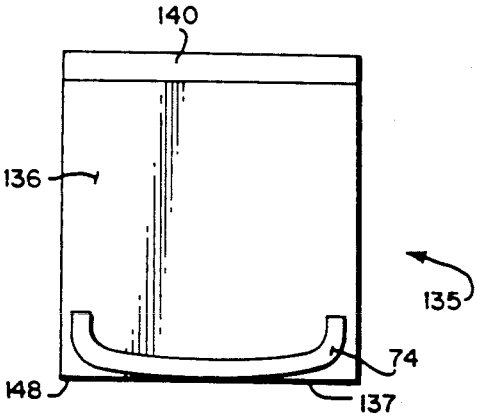
FIG. 10 is a bottom plan view of an exemplary backstop utilizable with the cart of FIGS. 8 and 9.

The forms backstop 135 is similar to the backstop 35 except that the bottom surface 136 thereof extends along the entire bottom of the backstop 135—see FIG. 10—rather than merely at edge portions. The lip 140 extends forward of the front surface 138 of the backstop. In order to provide for smooth and uniform movement, it is also desirable in this embodiment to provide the backstop 135 with a lubricant impregnated material 74 over at least a portion of the bottom thereof. As illustrated in FIG. 10, this material 74 may be provided in the form of a U-shape near the back corner edge 148 of the backstop 135. The material 74 could—for example—be a plastic material impregnated with molydisulfide, although many other materials (e.g. plastics or lubricants) are also suitable.

In this embodiment while a handle is provided, rather than the handle being externally of the back wall 137, it is formed as a cut out (not shown) in the back wall 137. This handle is primarily for lifting the backstop 135 easily since there is not as great a need to flip the forms in this embodiment —because the tilting action of the cart 114— than in the FIGS. 1 through 7 embodiment, but the handle can be used for the forms flipping purpose too.

Figure 11:
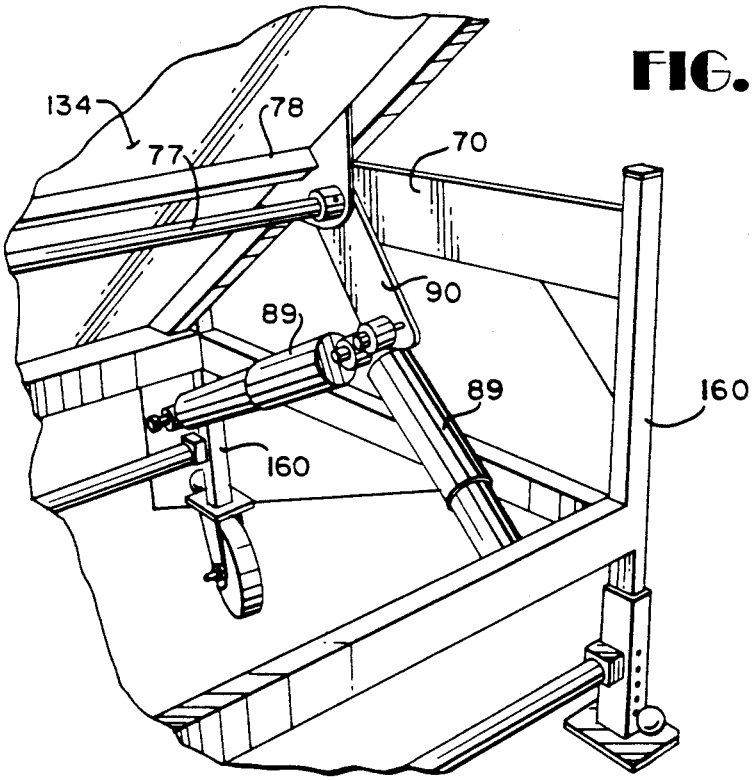
FIG. 11 is a detail perspective view of hydraulic shock absorbers associated with the cart of FIGS. 8 and 9.
Figure 12:
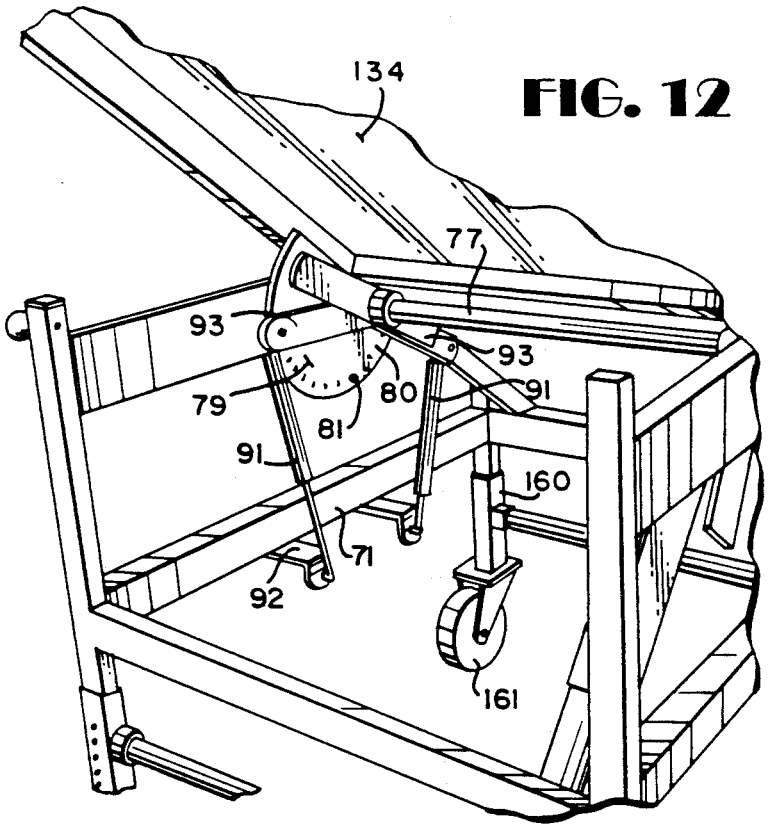
FIG. 12 is a detail perspective view of gas springs and a locking sector of the exemplary cart of FIGS. 8, 9, and 11.

The means for mounting the main surface 134 for tiltable movement about a horizontal axis is shown generally by reference numeral 75 in FIG. 8, and as can be seen in FIGS. 8, 11 and 12 comprises a steel shaft 77 which is journalled in the frame portions 70, and defines a horizontal axis. The flanges 78 (FIG. 11) and 79 (FIG. 12) which are welded or otherwise attached to the underside of the main surface 134, receive the shaft 77 therein. The surface 134 is held in a position to which it has been tilted by a detent mechanism which includes: a plurality of holes 80 formed in the locking sector bracket 79; a detent shaft 81 having knob 82 at the outer end thereof, and a spring mechanism (not shown) for spring loading the shaft 81/knob 82. The shaft 81 is biased into contact with the plate 79 so that when the knob 82 is released, the shaft 81 will automatically enter a hole 80 when the hole comes in alignment therewith.

In order to make sure that the surface 134 is held essentially perfectly horizontally during filling of the cart 114, the locking pins 84 are provided at the legs 160. While the pins 84 could be spring biased toward the surface 134, preferably they loosely slide in openings in the legs 160 and into a corresponding opening—e.g. opening 85 in FIG. 8—in the side of the main surface 134. These four pins 84 hold the surface 134 horizontally during forms loading, and must be pulled out and disengaged before the cart 114 can be moved to the tilted position illustrated in FIGS. 8, 11, and 12.

Tilting of the surface 134 is effected by an operator manually grasping one or more of the handles 87 and rotating one end of the cart 114 about the shaft 77. Of course it must be ensured that an end wall 154 is provided at the lowermost end after tilting, and preferably one is also provided at the highest end after tilting.

Since the cart 114 is fairly heavy, especially when loaded, care must be taken to damp its movements so that it does not fall and cause injury or damage. For that purpose it is desirable to provide a pair of hydraulic shock absorbers 89—see FIG. 11—which are each mounted at one end thereof to a leg 160, and at the other end thereof to an arm 90 which extends downwardly from the shaft 77. Both cylinders 89 are effective to damp any pivotal movement of the surface 134 about the shaft 77.

In order to provide an assist for effecting tilting—again because the cart, particularly when loaded, is so heavy—it is also desirable to provide gas springs, as illustrated in FIG. 12 by reference numerals 91. Each gas spring is mounted at the bottom thereof to a bracket 92 attached to the lower frame support 71, and at the upper end thereof to an arm 93 received by the shaft 77 and extending downwardly therefrom. Only one gas spring is effective at a time, one being effective for tilting movement in one direction, and the other for tilting movement in the other direction. This is accomplished by providing a conventional connection (not shown) between the arms 93 and the shaft 77 so that each arm 93 will rotate with the shaft in one direction, but not the other. The gas springs 91 serve much like the springs in a garage door to make the effective weight of the loaded cart bed 134 less during the tilting action.

Cart tilting is highly desirable from the standpoint of maintaining the folded forms so that they do not curl at the edges (because they are being supported along a bottom fold line thereof) if they are to be maintained stationary for a long period of time, and also because that facilitates the withdrawal operation. Typically, the forms are withdrawn from the elevated end of the cart, and—as with the FIGS. 1 through 7 embodiment—may be led directly from the elevated end into the forms utilization device, or first underneath and/or past the rollers 163, 162, under the bed between the legs 160, and then to the forms utilization device 65. Normally it is desirable to have an end wall 154 at both the bottom and top ends of the tilted cart, but under some circumstances an end wall at the top, elevated, end may not be necessary.

It will thus be seen that according to the present invention a method, system, and cart have been provided which greatly facilitate the stacking of forms from a laser printer, folder, and/or like equipment. By practicing the invention the amount of operator involvement in the forms accumulation and utilization function is much less, the operator need not lift stacks of forms onto and off of carts, and the mail insertion or like forms utilization equipment can run much longer since more forms can be easily supplied thereto without running out. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A moveable cart adapted to receive a plurality of continuous business forms in a compacted configuration from a folder unit and moving the plurality of forms to a forms utilization unit, comprising:

a forms backstop having a bottom surface, and a top;

a cart main surface for supporting compacted forms thereon, having a periphery and having means for providing appropriate frictional engagement with said forms backstop bottom surface and forms, while said backstop top extends upwardly above said main surface, to facilitate compacting forms, wherein said frictional engagement providing means comprises a corrugated configuration of said cart main surface, and wherein said forms backstop has a high lubricity material on at least a portion of the bottom surface thereof which engages said corrugated configuration, and wherein said corrugated configuration is aluminum;

wall means upstanding from said main surface around at least part of the periphery thereof, and defining at least one open end for receipt of forms; and a plurality of legs supporting said main surface, with roller means at the bottoms of said legs, said cart with said roller means adapted to be rolled into and out of position to receive said business forms in a compacted configuration from the folder unit.

2. A cart receipt of continuous business forms in a compacted configuration, comprising:

a forms backstop having a bottom surface, and a top;

a cart main surface for supporting compacted forms thereon, having a periphery and having means for providing appropriate frictional engagement with said forms backstop bottom surface and forms, while said backstop top extends upwardly above said main surface, to facilitate compacting of forms;

wall means upstanding from said main surface around at least part of the periphery thereof, and defining at least one openable end for receipt of forms; and wherein said frictional engagement providing means comprises a plurality of lugged belts, means for mounting the belts so that the lugs extend upwardly, and so that they are movable along said main surface, and low friction portions of said main surface disposed under said belts.

3. A cart for receipt of continuous business forms in a compacted configuration, comprising:

a forms backstop having a bottom surface, and a top;

a cart main surface for supporting compacted forms thereon, having a periphery and having means for providing appropriate frictional engagement with said forms backstop bottom surface and forms, while said backstop top extends upwardly above said main surface, to facilitate compacting of forms;

wall means upstanding from said main surface around at least part of the periphery thereof, and defining at least one openable end for receipt of forms;

wherein the volume between said legs is substantially open; and guide means extending below said main surface, for guiding forms after they have been compacted and while they are being withdrawn from said main surface.

4. A cart for receipt of continuous business forms in a compacted configuration, comprising:

a forms backstop having a bottom surface, and a top;

a cart main surface for supporting compacted forms thereon, having a periphery and having means for providing appropriate frictional engagement with said forms backstop bottom surface and forms, while said backstop top extends upwardly above said main surface, to facilitate compacting of forms;

wall means upstanding from said main surface around at least part of the periphery thereof, and defining at least one openable end for receipt of forms; and wherein said wall means comprises a first end wall upstanding from said main surface and at the opposite end of said main surface from said openable end, and electromagnetic radiation reflective means at a top portion of said firs end wall, but below the top of said forms backstop when said forms backstop is adjacent said first end wall.

5. A cart for receipt of continuous business forms in a compacted configuration, comprising:

a forms backstop having a bottom surface, and a top;

a cart main surface for supporting compacted forms thereon, having a periphery and having means for providing appropriate frictional engagement with said forms backstop bottom surface and forms, while said backstop top extends upwardly above said main surface, to facilitate compacting of forms;

wall means upstanding from said main surface around at least part of the periphery thereof, and defining at least one openable end for receipt of forms; and means for mounting said cart main surface with respect to said cart legs so that it may be tilted so that said first end is elevated or lowered after said cart is filled with forms.

6. A cart as recited in claim 5 further comprising detent means for maintaining said cart in a position to which it has been tilted.

7. A cart as recited in claim 5 wherein said means for mounting said cart comprises a shaft centrally located on said cart and disposed below said cart main surface and operatively attached thereto, for allowing rotation of said main surface about a horizontal axis; and releasable holding means for holding ends of said main surface stationary so that said main surface is generally horizontal until filled with forms.

8. A system for stacking continuous business forms in a compacted in-line configuration, comprising:

a folder for folding the continuous business forms along fold lines, and for conveying the folded forms in a first direction at a first speed;

means for mounting said conveying means adjacent said folder so that folded forms discharged by said folder are received by said conveying means;

a movable cart having a main surface, and a wall means upstanding from said main surface and defining a first, openable, end said main surface for receipt of forms discharged by said conveying means, said movable cat having caster means allowing said movable cart to be rolled into and out of position with said conveying means;

a forms backstop movable along said main surface in response to forms stacking thereagainst; and means for mounting said main surface adjacent said conveying means so that forms discharged by said conveying means compact on said forms backstop.

9. A system as recited in claim 8 further comprising means for sensing when said cart is full of forms and for operating a human-perceptible device in response to said sensing.

10. A system as recited in claim 9 wherein said cart has a second end defined by an end wall, opposite said first end, and wherein said sensing means comprises: means mounted on said folder for emitting and sensing electromagnetic radiation, and reflective means mounted on said second end wall below the top of said forms backstop, but in position to receive a beam of radiation emitted by said emitting and sensing means and reflect it back to said emitting and sensing means except when the beam of radiation is interrupted by said forms backstop indicating that said cart is full of forms.

11. A system as recited in claim 9 wherein said human perceptible device is a control for said folder, so that when said sensing means senses that said cart is full it operates said control to terminate operation of said folder.

12. A system as recited in claim 8 wherein the cart main surface is supported by a plurality of legs, and the volume between said legs is substantially open; and further comprising guide means extending below said main surface, for guiding forms after they have been compacted and while they are being withdrawn from said main surface.

13. A system as recited in claim 8 wherein said forms backstop has a top spaced from said main surface of said cart, and a bottom surface engaging said main surface of said cart; and further comprising a handle adjacent said top of said forms backstop.

14. A system as recited in claim 8 wherein said forms backstop has a top spaced from said main surface of said cart, and a bottom surface engaging said main surface of said cart; and further comprises an upstanding back surface, and a sloped front surface, said back and front surface intersecting at the top of said backstop at one end of each, and connected to or defining said bottom surface at an opposite end of each.

15. A system as recited in claim 8 wherein said cart main surface comprises a corrugated surface having the corrugations extending longitudinally.

16. A system as recited in claim 15 wherein said forms backstop has a high lubricity material on at least a portion of the bottom surface thereof which engages said corrugated surface.

17. A system for stacking continuous business forms in a compacted in-line configuration, comprising;

a folder for folding the continuous business forms along fold lines, and for conveying the folded forms in a first direction at a first speed;

conveying means for conveying forms received thereby in said first direction at a second speed, slower than said first speed;

means for mounting said conveying means adjacent said folder so that folded forms discharged by said folder are received by said conveying means;

a movable cart having a main surface, and wall means upstanding from said main surface and defining a first, openable, end, said main surface for receipt of forms discharged by said conveying means;

a forms backstop movable along said main surface in response to forms stacking thereagainst; and wherein said conveying means comprises a plurality of parallel continuous belts having lugs extending outwardly and inwardly, the outwardly extending lugs engaging forms conveyed thereby; and drive means for driving said belts at said second speed in said first direction, said inwardly extending lugs engaging said drive means.

18. A system for stacking continuous business forms in a compacted in-line configuration, comprising:

a folder for folding the continuous business forms along fold lines, and for conveying the folded forms in a first direction at a first speed;

conveying means for conveying forms received thereby in said first direction at a second speed, slower than said first speed;

means for mounting said conveying means adjacent said folder so that folded forms discharged by said folder are received by said conveying means;

a movable cart having a main surface, and wall means upstanding from said main surface and defining a first, openable, end, said main surface for receipt of forms discharged by said conveying means;

a forms backstop movable along said main surface in response to forms stacking thereagainst; and wherein said main surface of said cart comprises frictional engagement providing means comprising a plurality of lugged belts, means for mounting the belts so that the lugs extend upwardly, and so that they are movable along said main surface, and relatively friction free portions of said main surface disposed between said belts, said lugs engaging said forms backstop to provide frictional resistance to movement of said forms backstop by compacted forms.

19. A system for stacking continuous business forms in a compacted in-lien configuration, comprising:

folder for folding the continuous business forms along fold lines, and for conveying the folded forms in a first direction at a first speed;

conveying means for conveying forms received thereby in said first direction at a second speed, slower than said first speed;

means for mounting said conveying means adjacent said folder so that folded forms discharged by said folder are received by said conveying means;

a movable cart having a main surface, and wall means upstanding from said main surface and defining a first, openable, end, said main surface for receipt of forms discharged by said conveying means;

a forms backstop movable along said main surface in response to forms stacking thereagainst;

said cart main surface being supported by a plurality of cart legs having an open volume therebetween; and means for mounting said cart main surface for tilting movement with respect to said cart legs so that said first end may be elevated or lowered after said cart is filled with forms.

20. A system as recited in claim 19 further comprising detent means for maintaining said cart in a position to which it has been tilted.

21. A system as recited in claim 19 wherein said means for mounting said cart comprises a shaft centrally located on said cart and disposed between said cart main surface and operatively attached thereto, for allowing rotation of said main surface about a horizontal axis; and releasable holding means for holding ends of said main surface stationary so that said main surface is generally horizontal until filled with forms.

22. A method of compacting continuous business forms utilizing a movable cart with a forms backstop mounted thereon, comprising the steps of:

(a) folding the forms along fold lines;

(b) transporting the folded forms in a first direction at a first speed;

(c) physically engaging the forms being transported in the first direction at the first speed, and significantly slowing down their transport in the first direction to a second speed, lower than the first speed, so that the forms stand substantially upright on a folded edge;

(d) pushing the substantially upright forms in the first direction at the second speed into operative engagement with the forms backstop located on the movable cart so that the forms are compacted; and (e) once the movable cart is full of compacted forms, terminating feed of forms onto it, and replacing it with an empty cart.

23. A method as recited in claim 22 further comprising using a unit for utilizing the forms, and comprising the further steps of:

(f) moving the full cart from step (e) into operative association with the forms utilization unit; and then (g) feeding continuous forms from the cart to the form utilization unit.

24. A method as recited in claim 23 wherein the cart has a main surface which supports the compacted forms, and wherein step (g) is practiced by feeding the forms from the main surface under the main surface to the forms utilization unit.

25. A method as recited in claim 23 wherein the forms having desired printing on a first face thereof, and wherein step (g) is practiced to feed the forms into the forms utilization device with the first face down.

26. A method as recited in claim 23 wherein the cart has a main surface on which the forms are compacted, and wherein steps (a)–(e) are practiced by maintaining the main surface substantially horizontal.

27. A method as recited in claim 26 comprising the further step (h), after step (e), of tilting the main surface so that a first end thereof is substantially higher than an opposite end thereof; and wherein steps (f) and (g) are practiced so that the forms are fed from the first, higher, end of the cart to the forms utilization unit.

28. A method as recited in claim 27 wherein step (h) is practiced by manually tilting the main surface so that it makes an angle of roughly 30 degrees with respect to the horizontal.

29. A method as recited in claim 28 further comprising the step of damping the movement of the main surface during manual tilting.

* * * * *